United States Patent [19]

Kahmann et al.

[11] 4,216,918

[45] Aug. 12, 1980

[54] FIBERIZER

[75] Inventors: Albrecht Kahmann, Weingarten; Wolfgang Siewert, Ravensburg, both of Fed. Rep. of Germany

[73] Assignee: Escher Wyss GmbH, Winterthur, Switzerland

[21] Appl. No.: 940,999

[22] Filed: Sep. 11, 1978

Related U.S. Application Data

[63] Continuation of Ser. No. 805,183, Jun. 9, 1977, abandoned.

[30] Foreign Application Priority Data

Dec. 8, 1976 [CH] Switzerland ..... 15405/76

[51] Int. Cl.[2] ..... B02C 23/18; B02C 23/10

[52] U.S. Cl. ..... 241/46 B; 241/46.17; 241/79.1

[58] Field of Search ..... 241/46.17, 79.1, 46 B; 209/211

[56] References Cited

U.S. PATENT DOCUMENTS

| | | | |
|---|---|---|---|
| 2,701,642 | 2/1955 | Goodwin | 209/211 |
| 3,235,091 | 2/1966 | Doll et al. | 209/211 |
| 3,276,583 | 10/1966 | Carr | 209/211 |
| 3,558,484 | 1/1971 | Carr | 209/211 |
| 3,859,206 | 1/1975 | Baggaley | 241/46.17 |
| 3,942,728 | 3/1976 | Christ et al. | 241/46.17 |
| 3,945,576 | 3/1976 | Kahmann | 241/46.17 |

*Primary Examiner*—Richard B. Lazarus
*Attorney, Agent, or Firm*—Kenyon & Kenyon

[57] ABSTRACT

The fiberizer is constructed with a closed chamber provided with an inlet for a waste paper suspension as well as with discharge openings for stock, impurities of low specific gravity and impurities of high specific gravity. The rotor which serves to rotate the stock suspension within the vessel has a central duct which communicates the central part of the chamber with the discharge opening for the impurities of low specific gravity.

In one embodiment, the vessel is mounted vertically and has a downwardly tapering wall which terminates at an opening for the discharge of impurities of high specific gravity. In a second embodiment, the vessel has a conical end wall opposite the rotor which has an apex directed towards the rotor. In this embodiment, the opening for the discharge of impurities of high specific gravity can be disposed in the base of this end wall if the vessel is vertically positioned or in a sidewall if the vessel is horizontally oriented.

8 Claims, 5 Drawing Figures

23
24
11
10
12
17
22
-16-
20
21
13
-14-
5
6
15
2'
19
II
8
7
18
2
25
A
3
W
W
1
4

FIBERIZER

This is a continuation of application Ser. No. 805,183 filed June 9, 1977 and now abandoned.

This invention relates to a fiberizer. More particularly, this invention relates to a fiberizer for dissolving and sorting waste paper.

As is known, various types of devices have been used for refining paper stock such as waste paper. For example, in some cases, the devices have been in the form of stock pulpers as described in U.S. Pat. Nos. 3,942,728 and 3,945,576. In these cases, the stock pulper has been constructed as a container with an inlet means for a suspension of waste paper and various outlet means for stock, heavy weight impurities and lightweight impurities. In addition, a rotor is disposed within the container in order to rotate a suspension within the container so as to effect comminution and discharge of the various components of the suspension. As is known, the outlet for the lightweight impurities is disposed coaxially of the rotor on the opposite side of the container from the rotor.

Other devices for refining waste paper have also been known such as described in German Pat. No. 965,806 and U.S. Pat. Nos. 2,452,135; 3,698,649; 2,098,608; 2,220,676 and 2,218,449. In these devices, waste paper is pulped and sorted such that various impurities can be taken from a container through suitable outlets while stock is removed through a different outlet.

In these various types of devices, the separation of the lightweight impurities from the heavy weight impurities has sometimes been difficult. Further, these devices have been subject to a relatively great amount of wear over a period of time such that they become less efficient.

Accordingly, it is an object of the invention to provide a fiberizer which is capable of separating impurities of high specific gravity and low specific gravity in a relatively efficient manner from a waste paper suspension.

It is another object of the invention to provide a fiberizer which is of relatively long life.

It is another object of the invention to reduce the wear in fiberizers.

Briefly, the invention provides a fiberizer which comprises a closed vessel which defines a chamber with an inlet to the vessel for the introduction of a waste paper suspension into the chamber. In addition, the vessel has a plurality of openings for the discharge of stock, impurities of low specific gravity and impurities of high specific gravity from the chamber. Further, a screen is disposed between the chamber and the discharge opening for the stock for screening of the stock while a rotor is rotatably mounted in and about an axis of the vessel with a plurality of arms for moving across the screen to rotate the stock suspension in the chamber. In accordance with the invention, the rotor is provided with a central duct which communicates the chamber with the discharge opening for the discharge of impurities of low specific gravity.

During operation, a waste paper suspension is delivered into the vessel via the inlet and the rotor is positively rotated so as to rotate the suspension with the vessel while at the same time screening stock via the screen through the stock discharge opening. At the same time, the heavy specific gravity impurities are moved outwardly from the axis of the vessel while the low specific gravity impurities tend to accumulate on the axis of the vessel. These low specific gravity impurities tend to move into the central duct in the rotor and are separated out via the discharge opening for the same.

Due to the fact that the low specific gravity impurities (i.e. lightweight impurities) are lead off through the central duct of the rotor, an improved separation of these impurities is obtained. This is facilitated since the centrifugal effect is greatest in the vicinity of the rotor. Hence, a sharp separation is achieved.

In order to accommodate the central duct within the rotor, the rotor has an axially extending shaft in a portion of which, the central duct is formed. In addition, the vessel is provided with a plenum between the central duct of the rotor and the discharge opening for the low specific gravity impurities while the central duct is provided with an outlet end with a direction component radial to the shaft so as to exit into the plenum. In this case, not only is a simple construction of the shaft obtained as the duct need not extend through the entire shaft, but also a certain amount of pumping action is obtained, as the duct is constructed in the manner of known sludge pumps.

In one embodiment, the vessel is in the shape of a body of revolution with a conical peripheral wall defining the chamber, with the wall having a diameter increasing in the direction away from the rotor. This aids, on the one hand, in the diversion of the flow from the rotor outwardly into an axial flow and facilitiates, on the other hand, a rapid removal of heavy components along the conical wall into an outlet opening.

In another embodiment, the vessel has an end wall of conical shape opposite the rotor in order to bound the chamber. This end wall further has an apex directed towards the rotor while the discharge opening for the heavy components is disposed in a circumferential region of the end wall. These features further aid in the rapid separation of the heavy components and thus contribute toward the reduction of wear or erosion of the vessel due to these impurities. The vessel may also have a channel with an increasing depth in the direction of rotation of the stock suspension to communicate the chamber with the discharge opening for the heavy components. In this case, the discharge opening is positioned at the lowest point of the channel. Further, an upstanding wall is positioned at a terminal end of the channel adjacent to the discharge opening to facilitate removal of the heavy components. This embodiment may be oriented on either a vertical axis or a horizontal axis.

In another embodiment, the vessel can be disposed on a vertical axis with the rotor and discharge opening for the low specific gravity impurities at the upper end of the chamber while the discharge opening for the high specific gravity impurities is located at a lower end of the chamber. In this case, the flow conditions are particularly favorable as the low specific gravity impurities can rise from the center of the vortex flow in the vessel to the top in an undisturbed manner while the heavier impurities can sink down along the outer wall of the vessel. This embodiment is particularly useful where the vessel has a conical peripheral wall with a diameter which decreases in a direction away from the rotor and an outlet opening at the narrowest point of the wall.

The screen which is used in the fiberizer may be of conical shape with a cone apex projecting into the vessel. In this case, the heavy impurities which would otherwise cause wear of the screen are removed from the screen by centrifugal force so that the wear is avoided. At the same time, the risk of the heavy particles becoming jammed between the screen and the rotor is also avoided.

These and other objects and advantages of the invention will become more apparent from the following detailed description and appended claims taken in conjunction with the accompanying drawings in which:

Figure 1:
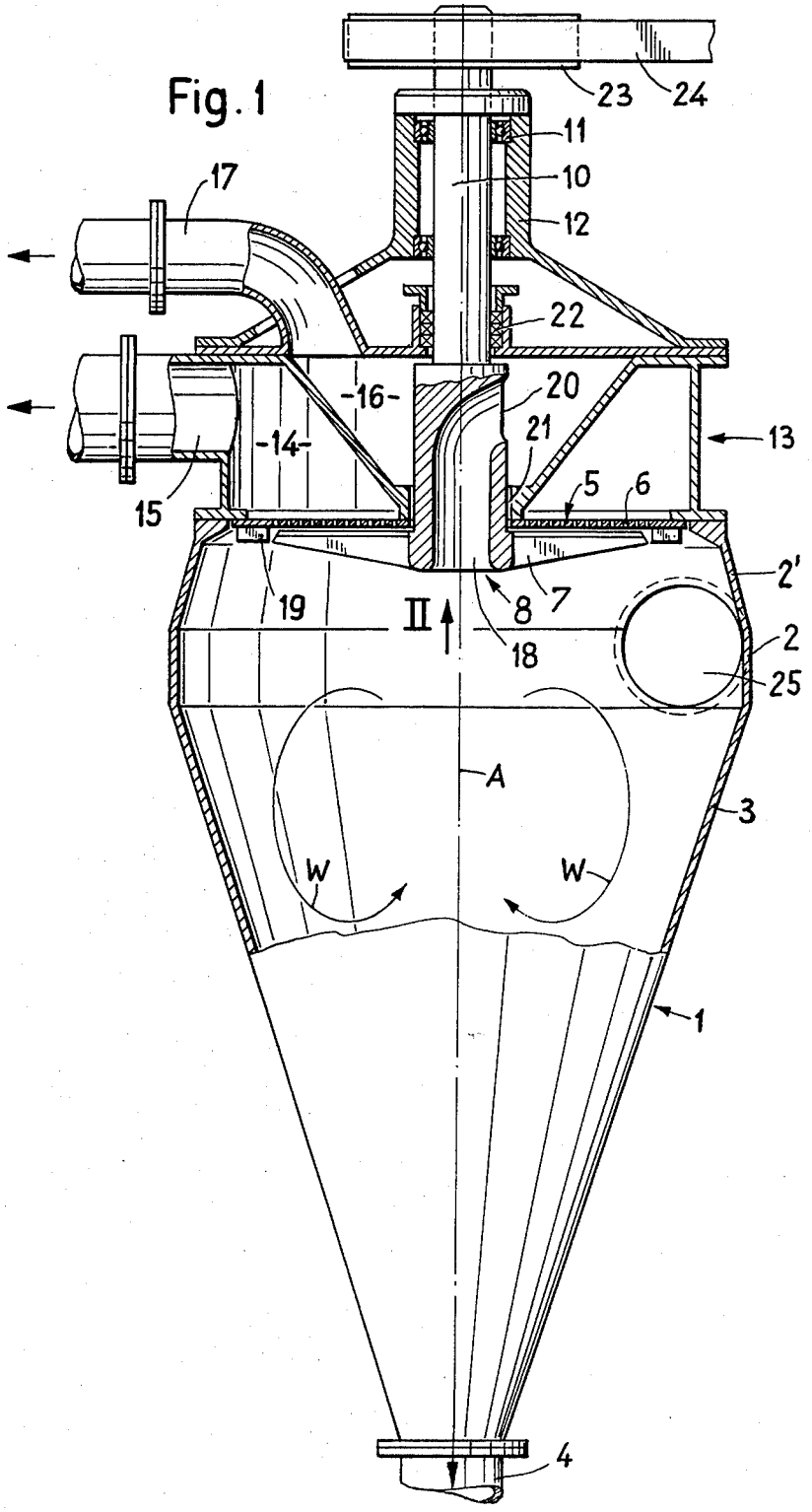
FIG. 1 illustrates a cross-sectional view of a fiberizer in accordance with the invention.

Referring to FIG. 1, the fiberizer which is used for pulping and sorting a waste paper suspension includes a vessel of closed construction which is disposed on a vertical axis A so as to define a suspension chamber. As shown, the vessel 1 has a shape of a body of revolution with two peripheral walls 2', 2 which are each tapered outwardly and downwardly from the upper end of the vessel 1 and a conical peripheral wall 3 which has a diameter which decreases in a direction away from the upper end. A discharge opening 4 is located at the narrow end of the wall 3, i.e. at the bottom as viewed, so as to form a discharge opening for separated impurities of high specific gravity.

At the upper end, the chamber of the vessel 1 is defined by a wall 5 in the form of a screen 6. In addition, a rotor 8 is rotatably mounted on the axis A and is provided with a plurality of arms 7 for moving across the screen 6. As shown, the rotor 8 has a shaft 10 which extends axially upwardly and which is supported via bearings 11 in a bearing housing 12 mounted on a housing 13 located at the upper end of the vessel 1.

The housing 13 may be secured in any suitable manner to the upper end of the vessel 1. This housing 13 also contains a plenum 14 on an opposite side of the screen 6 from the suspension chamber to receive materials (e.g. stock) screened through the screen 6. This plenum 14 also communicates with a discharge opening 15 in the form of an outlet stub in the vessel 1 in order to discharge the screened stock. The stub 15 is, in turn, connected to a suitable line for the discharge of the stock.

In addition, the housing 13 also contains a second plenum 16 which surrounds the shaft 10 and which communicates with a discharge opening 17 in the form of a pipe stub so as to discharge impurities of low specific gravity. The pipe stub 17 is also connected to a suitable line for the discharge of these impurities.

In order to communicate the plenum 16 with the chamber of the vessel 1, the shaft 8 is provided with a central duct 18. This duct 18 extends through a portion of the shaft 10 and has an outlet end 20 exiting into the plenum 18 with a direction component radial to the shaft 10.

As further shown in FIG. 1, the shaft 10 extends through the housing 13 with a slight clearance 21. In addition, a packing or seal 22 is arranged between the housing 13 and the shaft 10 so as to prevent material from leaking out of the vessel 1.

In order to drive the shaft 10, a pulley 23 is secured to an exposed end of the shaft 10 and a belt 24 is passed about the pulley 23 so as to drive the pulley 23 from a motor (not shown) in known manner.

The vessel 1 is also provided with an inlet 25 which opens tangentially into the chamber of the vessel 1 for the introduction of a waste paper suspension into the chamber.

In operation, a waste paper suspension which is pretreated, for example in a pulper, is fed into the vessel 1 through the inlet 25. Such a suspension may contain impurities of low specific gravity such as pieces of paper, plastic foil and plastic foam particles as well as impurities of high specific gravity such as staples and other metal parts, and general impurities such as rocks, glass splinters and the like.

Under the influence of the rotating rotor 8, a rotational flow of the suspension about the axis A occurs as well as a circulation flow which is indicated by the arrows W. The light impurities collect at the core of the vortex and can then be discharged through the duct 18, the plenum 16 and the stub 17. This separation and removal is facilitated by the fact that the light impurities have a natural tendency to rise in the liquid suspension contained in the vessel 1. This tendency is further aided by the rising circular flow W.

The heavy impurities contained in the suspension are seized by the vortex about the axis A and the circulation flow W and are moved along the walls 2', 2, 3 into the lower region of the vessel. Separation and removal of these latter impurities through the discharge opening 4 is aided by the fact that the circulation flow W is considerably weaker in the lower region of the vessel 1. Thus, the heavy particles may readily sink down into the opening 4.

Figure 2:
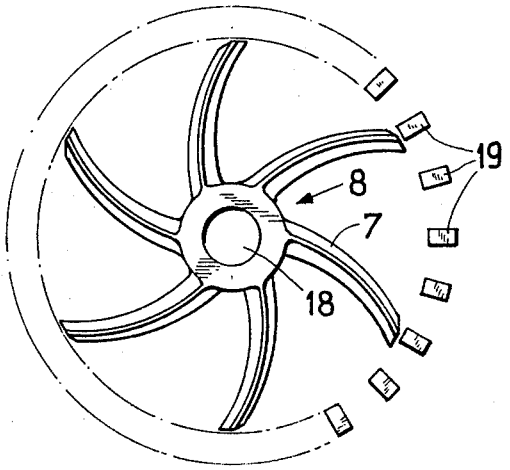
FIG. 2 illustrates a view taken in the direction of arrow II in FIG. 1.

The purified material, i.e. stock, formed in the vessel 1 and which is comminuted by the arms 7 of the rotor 8 as well as by baffles 19 fixed to the screen 6 about the arms 7 (see FIG. 2), is discharged through the screen 6, plenum 14 and stub 16 for subsequent use.

Figure 3:
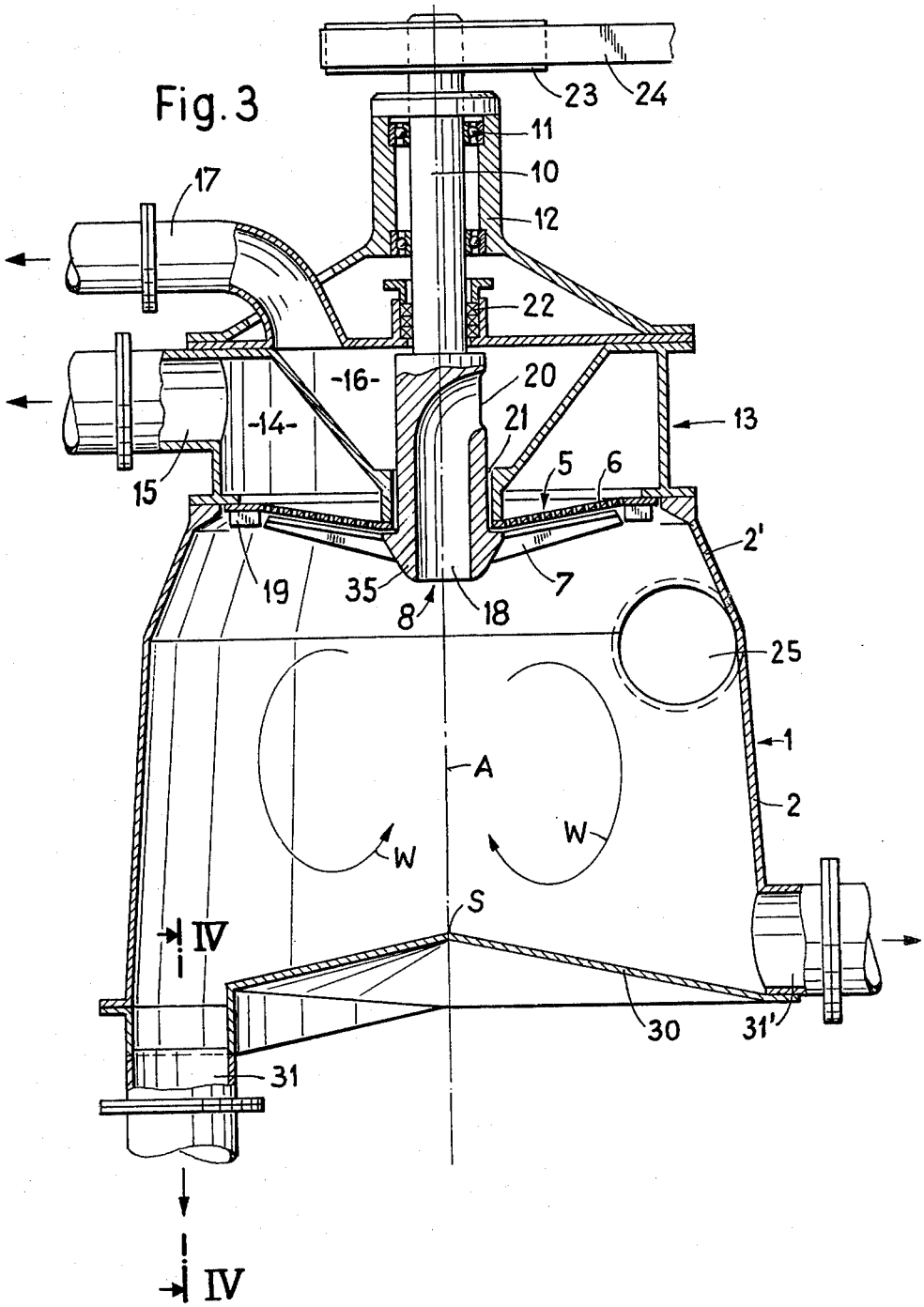
FIG. 3 illustrates a cross-sectional view of a further fiberizer in accordance with the invention.

Referring to FIG. 3, wherein like reference characters indicate like parts as above, the fiberizer has a conical wall 2 which has a diameter which increases in the direction away from the rotor and terminates in an end wall 30. This end wall 30 is disposed opposite to the rotor 8 in order to bound the chamber and has an apex S directed towards the rotor 8. As shown, the vessel also has two outlet openings 31, 31' located in a circumferential region in the end wall 30.

Figure 4:
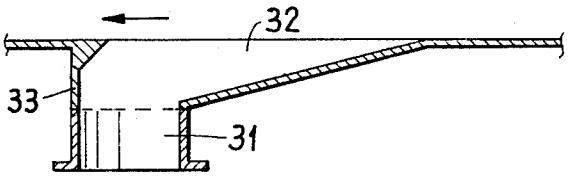
FIG. 4 illustrates a developed view taken along line IV—IV of FIG. 4.

Referring to FIGS. 3 and 4, the outlet opening 31 located in the end wall 30 communicates via a channel 32 with the chamber of the vessel 1. As shown in FIG. 4, the channel has an increasing depth in the direction of rotation of the stock suspension within the chamber, i.e. in the direction of rotation of the rotor 8. In addition, an upstanding wall 33 is disposed at a terminal end of the channel 32 adjacent to the discharge opening 31 to act as a baffle.

Referring to FIG. 3, when in operation, the fiberizer causes the heavy impurities to move along the conical wall to the bottom wall 30 and thereafter into the channel 32 for discharge through the outlet opening 31. The channel 32 thus facilitates removal of the heavy impurities from the chamber of the vessel 1. Further, the channel may extend along a part of the circumference of the vessel 1 or along the entire circumference.

Figure 5:
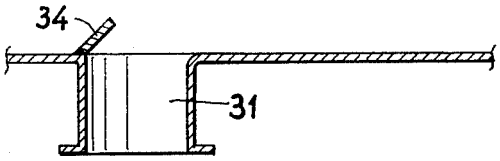
FIG. 5 illustrates a view similar to FIG. 4 of a further modified discharge opening for high specific gravity impurities in accordance with the invention.

Referring to FIG. 5, instead of using a channel, a baffle plate 34 is provided to form a vertical wall at the discharge opening 31 in order to facilitate the inflow of heavy impurities into the opening 31. This baffle 34 functions in the same manner as the wall 33 (FIG. 4) in preventing the heavy impurities from circulating continuously aong the circumference of the end wall 30.

As shown in FIG. 3, the rotor 8 can be provided with a conical extension 35 which extends towards the interior of the vessel 1. Such an extension facilitates the flow of the light impurities into the central duct 18. Further, the screen 6 may also be of conical shape with a cone apex projecting into the vessel 1.

The fiberizer of FIG. 3 can be arranged, as shown, in a vertical position or may be arranged with the axis A horizontally or at an incline. In some cases, this may also apply to the fiberizer as shown in FIG. 1. Although two outlet openings 31, 31' are provided in the fiberizer of FIG. 3, only one is used as a rule. Thus, the outlet opening 31 in the end wall is suited for a vertical arrangement of the fiberizer while the outlet opening 31' in the conical wall 2 is suited for an arrangement with the axis A horizontal. It is also understood that in a horizontal arrangement, the outlet opening 31 or 31' can be provided at the lowest point of the vessel. Further, both outlet openings 31, 31' may be made with or without a channel 32 and with or without a baffle plate 34.

As described above, the screen 6 of FIG. 1 is of flat shape whereas the screen 6 of FIG. 3 is conical. The flat screen 6 has the advantage that it is the least expensive to manufacture and should have a sufficiently long service life in the fiberizer, in most cases. The conical screen, which is known per se from U.S. Pat. No. 3,945,576, is somewhat more expensive to manufacture but has the advantage that in operation, heavy particles are moved away from the screen by the centrifugal force acting on the particles. This reduces the wear of the screen due to the heavy particles and also reduces the danger that the heavy particles become jammed between the screen 6 and the arms 7 of the rotor 8.

What is claimed is:

1. A fiberizer comprising a vertically disposed vessel of closed construction defining a suspension chamber about a vertical axis having an inlet for the introduction of a waste paper suspension into said chamber, a screen at an upper end of said chamber to define a wall of said chamber for screening stock from a waste paper suspension in said chamber and a discharge opening at a lower end of said chamber for the discharge of impurities of high specific gravity from said chamber;

a housing mounted on said vessel at said upper end, said housing having a first discharge opening for the discharge of stock passing through said screen and a second discharge opening for the discharge of impurities of low specific gravity; and a rotor rotatably mounted about said axis of said vessel, said rotor having a plurality of arms disposed in said chamber for moving across said screen to rotate the stock suspension in said chamber about said axis and to circulate the stock suspension in said chamber while comminuting the stock suspension, said rotor extending through said housing and having a central duct on said axis communicating said chamber with said second discharge opening in said housing for discharging impurities of low specific gravity.

2. A fiberizer as set forth in claim 1 wherein said housing includes a plenum between said duct and said second discharge opening and said rotor has an axially extending shaft passing through said plenum with said central duct within said shaft, said central duct having an outlet end with a direction component radial to said shaft and exiting into said plenum.

3. A fiberizer as set forth in claim 2 wherein said housing includes a second plenum between said screen and said first discharge opening.

4. A fiberizer as set forth in claim 1 wherein said vessel is of a shape of a body of revolution with a conical peripheral wall defining said chamber, said wall having a diameter increasing in a direction away from said rotor.

5. A fiberizer as set forth in claim 4 wherein said vessel has an end wall of conical shape opposite said rotor to bound said chamber, said end wall having an apex directed towards said rotor, said discharge opening in said vessel being located in a circumferential region of said end wall.

6. A fiberizer as set forth in claim 5 wherein said vessel includes a channel having an increasing depth in the direction of rotation of the stock suspension in said chamber, said channel communicating said chamber with said discharge opening in said vessel and a vertical wall at a terminal end of said channel adjacent said latter discharge opening.

7. A fiberizer as set forth in claim 1 wherein said vessel has a peripheral wall tapered outwardly and downwardly from said upper end and a conical peripheral wall defining at least a part of said chamber, said conical peripheral wall having a diameter decreasing in a direction away from said outwardly tapered wall and said rotor, said discharge opening in said vessel being disposed at the narrowest point of said conical peripheral wall.

8. A fiberizer as set forth in claim 1 wherein said screen is of conical shape with a cone apex projecting into said vessel.

* * * * *